US006953372B2

(12) United States Patent
Takada

(10) Patent No.: US 6,953,372 B2
(45) Date of Patent: Oct. 11, 2005

(54) CONNECTOR WITH PRESS-IN TERMINAL FITTINGS AND RECESSED BULGES SURROUNDING THE TERMINAL FITTINGS

(75) Inventor: Kiyokazu Takada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/705,044

(22) Filed: Nov. 10, 2003

(65) Prior Publication Data

US 2004/0097139 A1 May 20, 2004

(30) Foreign Application Priority Data

Nov. 11, 2002 (JP) ..... 2002-327297

(51) Int. Cl.[7] ..... H01R 13/40
(52) U.S. Cl. ..... 439/733.1; 439/682
(58) Field of Search ..... 439/733.1, 752.5, 439/603, 682, 692, 732

(56) References Cited

U.S. PATENT DOCUMENTS 5,108,317 A 4/1992 Beinhaur et al.
5,263,880 A * 11/1993 Schwarz et al. ..... 439/733.1
5,839,920 A 11/1998 Yurko et al. ..... 439/587
5,885,113 A 3/1999 Bricaud
5,921,788 A * 7/1999 Wilson et al. ..... 439/733.1
6,139,373 A * 10/2000 Ward et al. ..... 439/733.1
6,250,969 B1 * 6/2001 Cai ..... 439/682
2002/0160638 A1 10/2002 Hamai et al.

FOREIGN PATENT DOCUMENTS

GB 2 046 533 11/1980
JP 2000-082515 3/2000
JP 2000-123895 4/2000

* cited by examiner

*Primary Examiner*—Renee Luebke
(74) *Attorney, Agent, or Firm*—Gerald E. Hespos; Anthony J. Casella

(57) ABSTRACT

A connector (10) has a housing (11) with a wall (11*a*) formed with press-in holes (13). Terminal fittings (30) are pressed into press-in the holes (13) so that leading ends of the terminal fittings (30) with respect to the pressing direction (PD) project out from a facing surface (15) of the wall (11*a*) to face a mating connector (40). Recesses (17) are formed in the facing surface (15) adjacent the press-in holes (13). Bulges (13*a*) may be formed near the press-in hole (13) due to forces created when the terminal fitting (30) is pressed into the press-in hole (13). However, the bulges (13*a*) are accommodated in the recesses (17), and will not interfere with the mating connector (40).

17 Claims, 10 Drawing Sheets

CONNECTOR WITH PRESS-IN TERMINAL FITTINGS AND RECESSED BULGES SURROUNDING THE TERMINAL FITTINGS

BACKGROUND OF THE INVENTION

1. Field of the Invention

The invention relates to a connector constructed by piercing narrow and long pin-shaped terminal fittings into a housing.

2. Description of the Related Art

A circuit board connector has a synthetic resin housing that can be fixed to a circuit board. The housing is formed with press-in holes and terminal fittings in the form of narrow and long pins are assembled to the housing by being pressed through the press-in holes. Each terminal fitting has a terminal connecting end that projects from a surface of the housing that will face a mating connector. Thus, the terminal connecting end of the terminal fitting can be connected with a mating terminal fitting. Each terminal fitting also has a board-connecting end that is inserted into a through hole in the circuit board. A connector of this type is shown, for example, Japanese Unexamined Patent Publication No. 2000-82515.

Terminal fittings theoretically can be pressed into the press-in hole of the housing from either direction. However, press-type terminal fittings are configured to contact the inner wall of the through hole of the circuit board resiliently without solder. These terminal fittings have a thick press-contact portion, and hence can be inserted only from the terminal connecting portion.

The press-in holes of a housing are slightly smaller than the terminal fittings to restrict loose movements of the terminal fittings. Thus, a portion of the inner wall of the press-in hole may bulge out toward an outer surface of the housing at an exiting side of the terminal fitting in the pressing direction.

Accordingly, a press-type terminal fitting that is inserted into the press-in hole from the terminal connecting portion may cause part of the inner wall of the press-in hole to bulge toward the mating connector. The mating connector may abut against the bulge, and the connectors may not connect to a proper depth.

The invention was developed in view of the above problem and an object thereof is to improve operability of the connector.

SUMMARY OF THE INVENTION

The invention is a connector with a housing that has at least one press-in hole extending therethrough. At least one long narrow terminal fitting is pressed into the press-in hole in the housing so that a leading end of the terminal fitting with respect to the pressing direction projects out from a facing surface of the housing to face a mating connector. At least one recess is formed in the facing surface adjacent the press-in hole. Accordingly, any bulge created by the insertion of terminal fitting will not project from the facing surface of the housing to face the mating connector. Rather, any such bulge exists only in the recess and, therefore, does not project out from the facing surface.

The recess preferably extends circumferentially around each press-in hole on the facing surface. Accordingly, the bulge is accommodated in the recesses regardless the side of the respective press-in hole on which the bulge is formed.

The depth of the recesses is set to substantially fully accommodate bulges created by the insertion of the terminal fittings into the press-in holes.

A terminal connecting portion of the terminal fitting to be pressed in the press-in hole preferably is slightly larger than the press-in hole. Accordingly, the terminal fitting can be held securely in the press-in hole.

The press-in holes preferably are formed in projections formed integrally or unitarily on the housing. Accordingly, the projections can support the terminal fittings properly while reducing the overall weight of the housing as compared to a housing having a greater thickness.

The entrance side of the press-in hole preferably comprises guides for guiding the terminal fitting into the press-in hole. Accordingly, the terminal fittings can be inserted smoothly, thus improving the overall operational efficiency and reducing the risk of bulges being formed excessively.

The terminal fittings preferably are bent at an angle and most preferably substantially normal to the pushing direction.

An alignment member may be provided for correctly positioning portions of the terminal fittings.

A cam means preferably is provided for cooperating with a mating cam means and displaying a cam action that facilitates connection of the connector with a mating connector. Accordingly, operability of the connection process is improved.

The terminal fittings may comprise a resilient connecting portion for resilient contact with a contact member, such as a circuit board.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
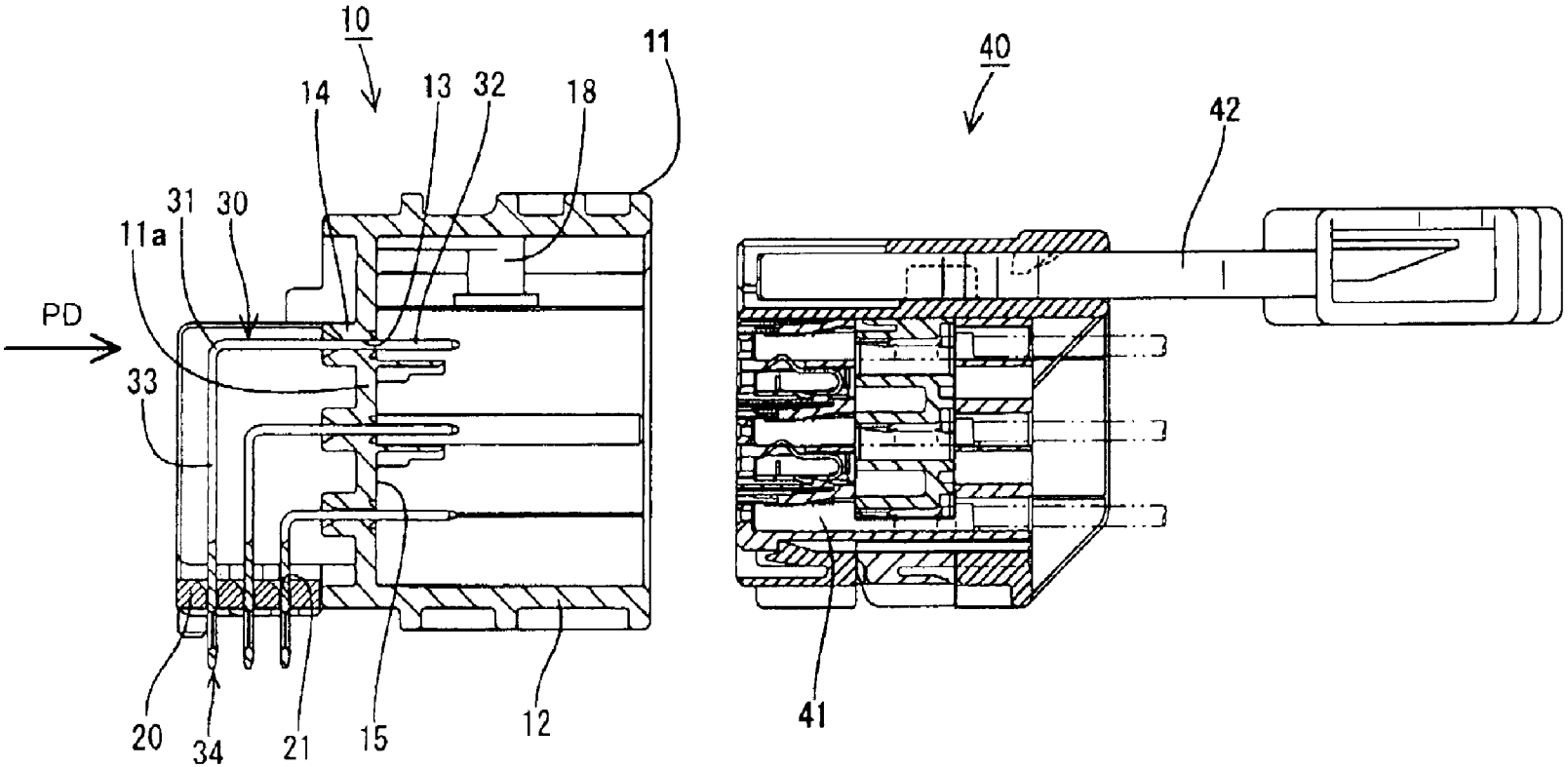
FIG. 1 is an exploded vertical cross-sectional view of a connector and mating connector according to one embodiment of the invention.
Figure 2:
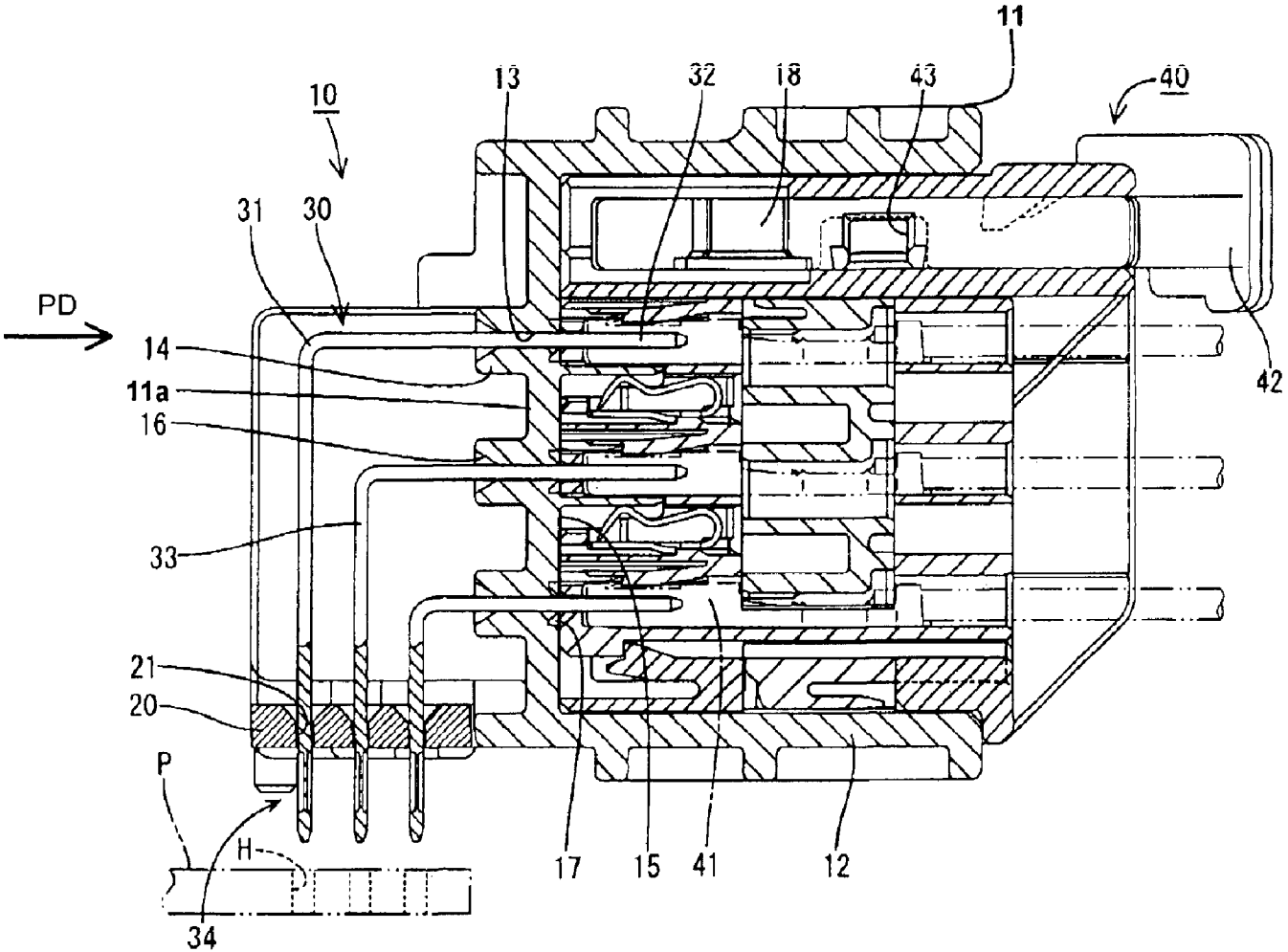
FIG. 2 is a vertical section of the connector connected with the mating connector.

A circuit board connector according to a preferred embodiment of the invention is identified by the numeral 10 in FIGS. 1 to 10. In the following description, a mating side of the connector 10 (right side in FIGS. 1 to 5, 7 to 10) with a mating connector 40 is referred to as the front side concerning forward and backward directions and reference is made to FIGS. 1 and 2 concerning vertical direction.

The circuit board connector 10 includes a housing 11 made e.g. of a synthetic resin. The housing 11 has a substantially rectangular rear wall 11*a* and a rectangular tubular receptacle 12 that projects forward from the outer periphery of the rear wall 11*a*. Press-in holes 13 penetrate the rear wall 11*a* in forward and backward directions and are aligned vertically and transversely. Projections 14 project back from areas of the rear wall 11*a* corresponding to the respective press-in holes 13, and the press-in holes 13 penetrate the corresponding projections 14. The front end of each press-in hole 13 makes a substantially rectangular opening in the front facing surface 15 of the rear wall 11*a* to face a female connector 40. The rear end of each press-in hole 13 makes a substantially rectangular opening in the rear end surface of the corresponding projection 14. Each projection 14 has a tapered guide 16 recessed to surround the opening edge of the press-in hole 13 at the rear end surface. The tapered guide 16 is slanted to enlarge each press-in hole 13 towards a distal end of the respective projection 14.

Figure 3:
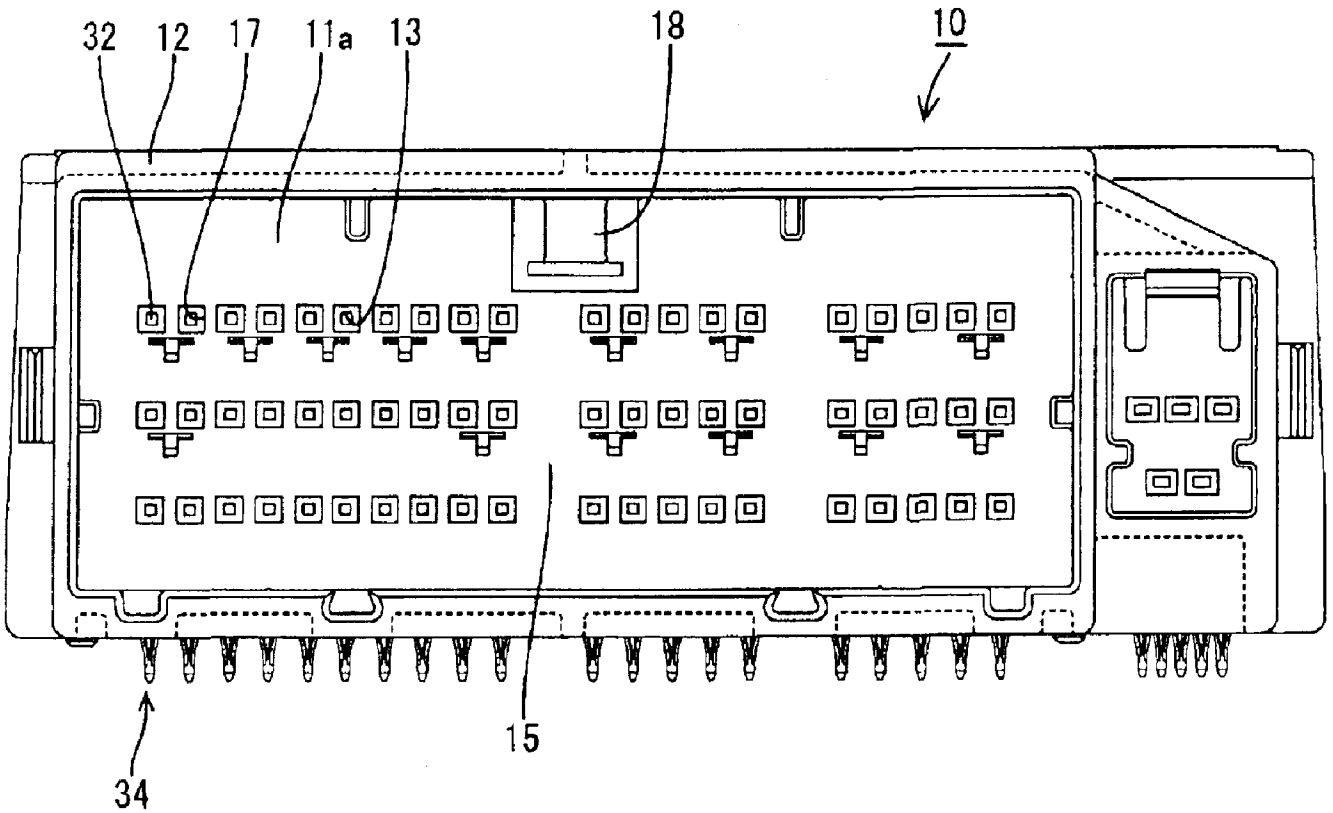
FIG. 3 is a front view of a housing.
Figure 4:
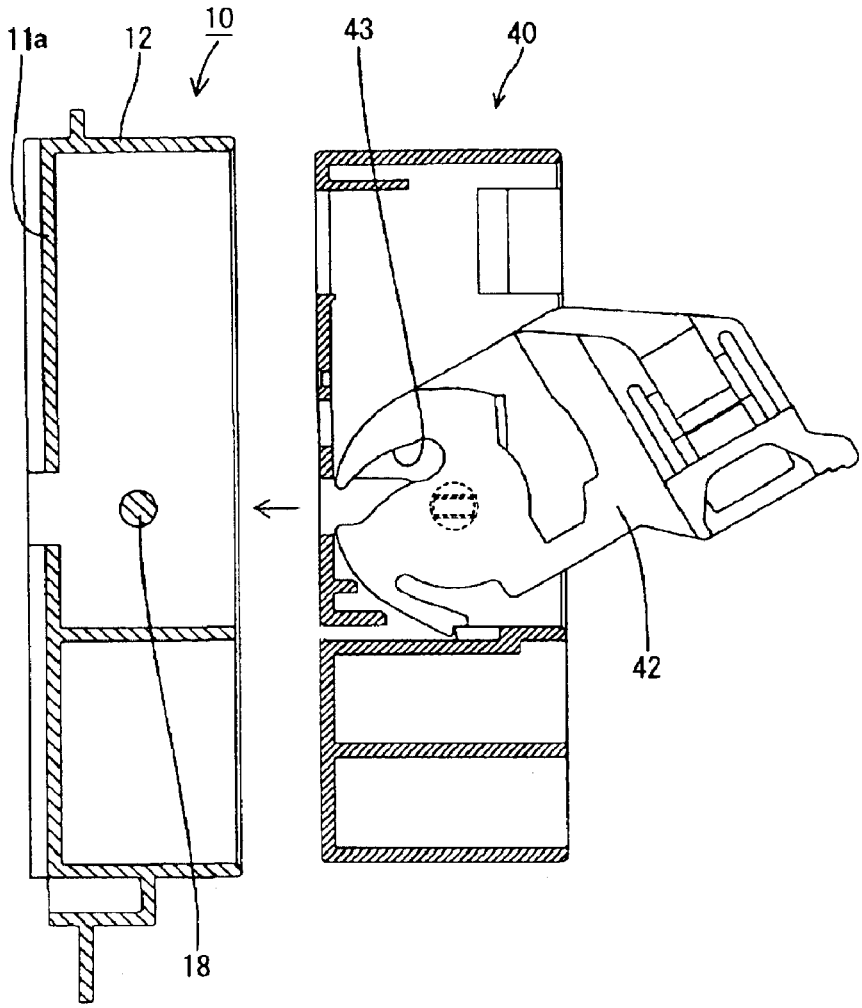
FIG. 4 is an exploded cross-section showing the lever and cam pin.
Figure 5:
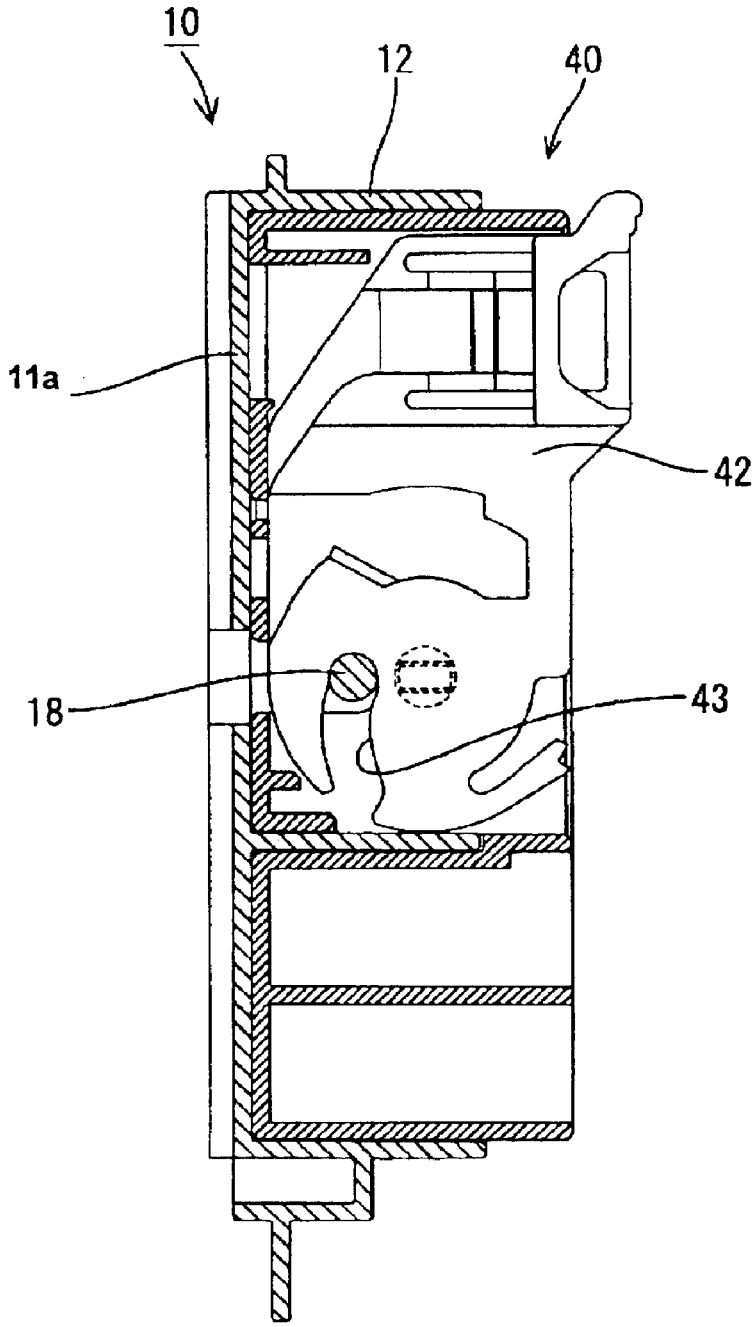
FIG. 5 is a cross-section similar to FIG. 4, but showing the connector fully connected with the mating connector.
Figure 6:
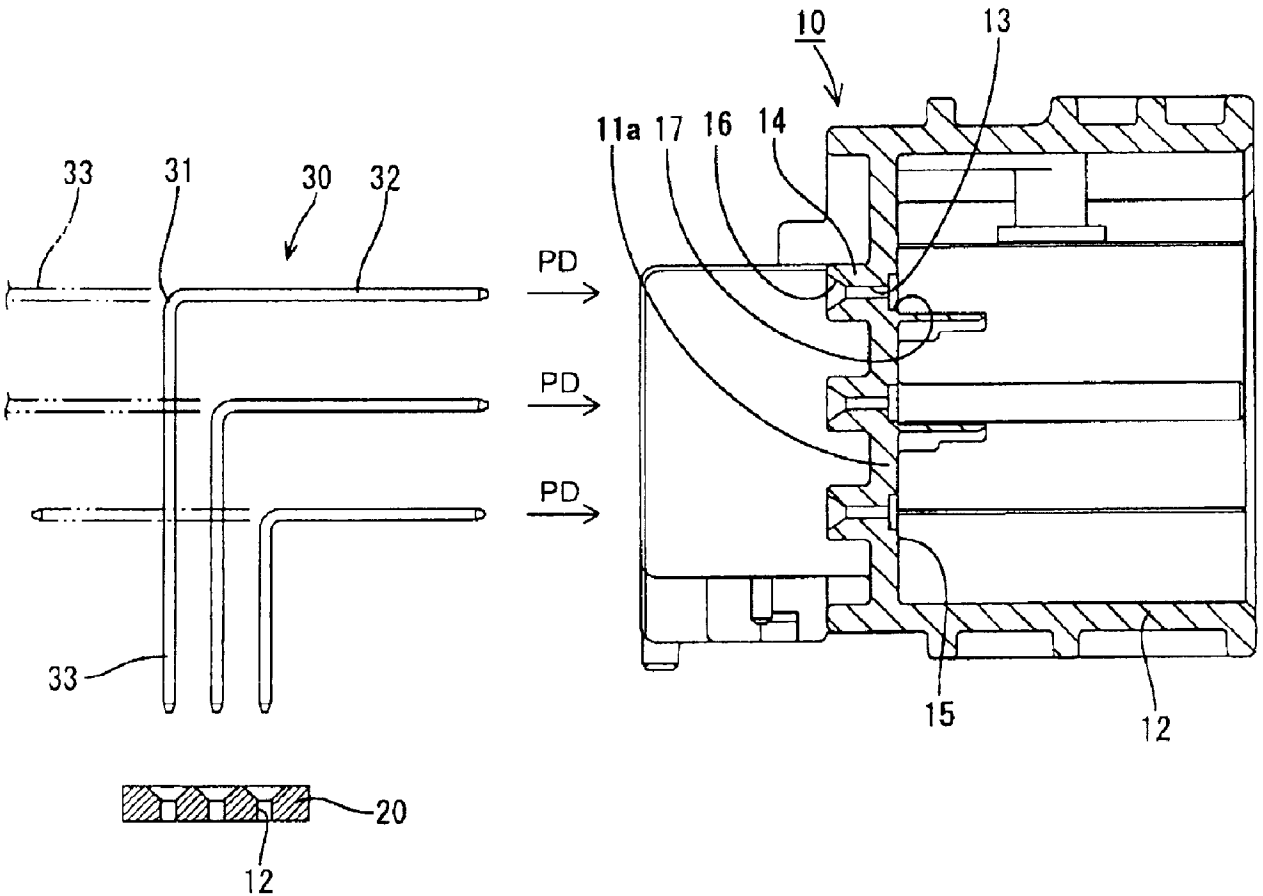
FIG. 6 is an exploded cross-section of terminal fittings and the housing.
Figure 7:
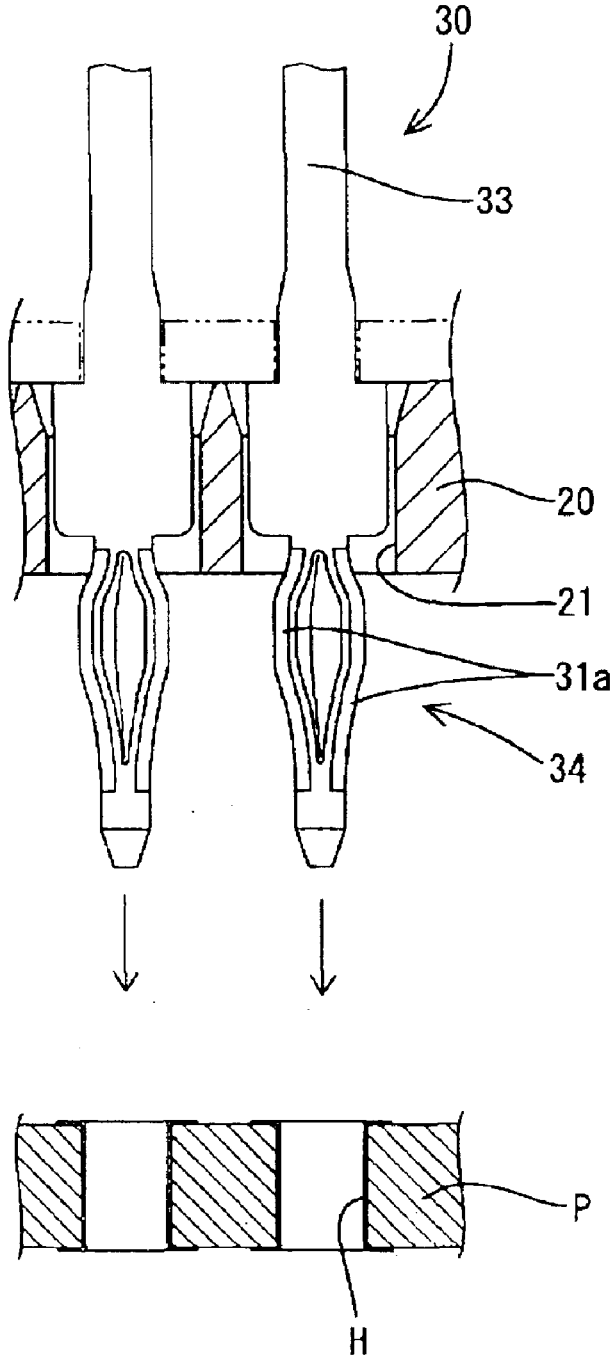
FIG. 7 is an exploded cross-section of the connector and a circuit board.
Figure 8:
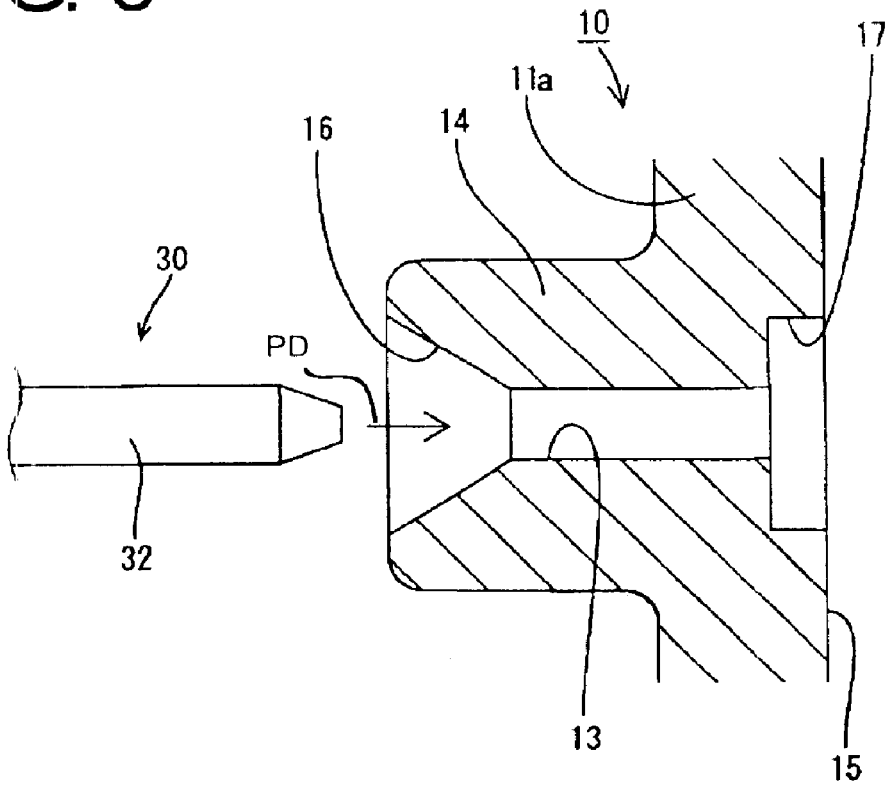
FIG. 8 is an exploded cross-section of a terminal fitting and the press-in hole.
Figure 9:
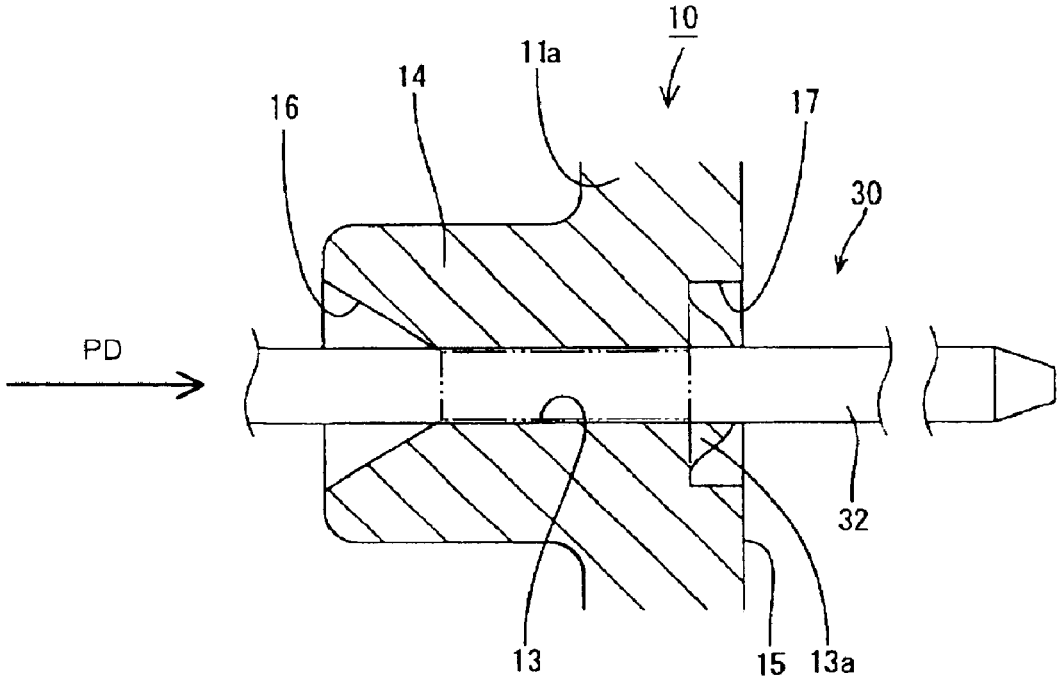
FIG. 9 is a cross-section showing the terminal fitting in the press-in hole.
Figure 10:
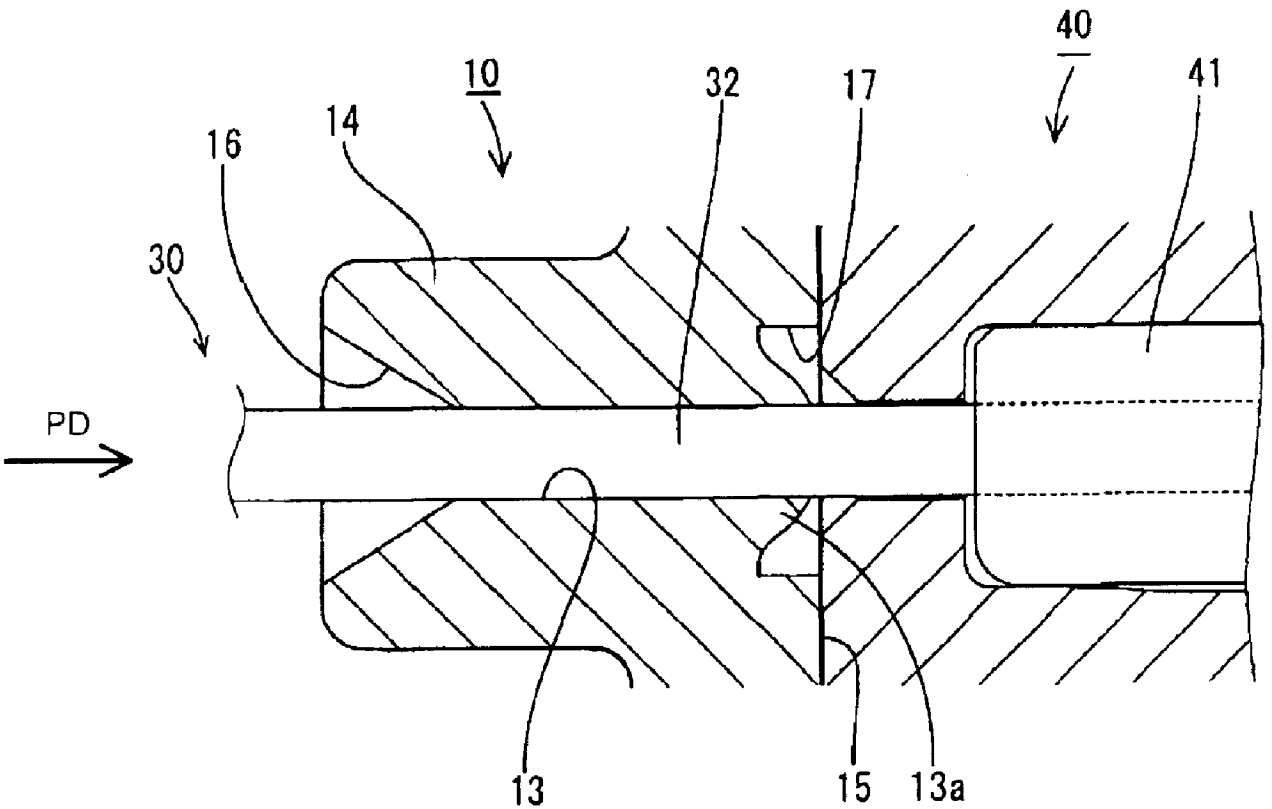
FIG. 10 is a vertical section showing the connector is connected with the mating connector.

Recesses 17 are formed in the facing surface 15 of the rear wall 11*a* at the inner or back end of the receptacle 12. The recesses 17 are formed around the entire peripheries of the respective press-in holes 13. The recesses 17 are substantially rectangular dents in the facing surface 15 when viewed from the front (FIG. 3). Thus, the openings of the press-in holes 13 and the recesses 17 have similar shapes in the facing surface 15.

A cam pin 18 projects down into the receptacle 12 from the upper wall of the receptacle 12. An alignment plate 20 is mounted at the bottom end of the rear wall 11*a* and projects back substantially flush with the bottom wall of the receptacle 12. Positioning holes 21 penetrate the alignment plate 20 vertically along its thickness direction.

The connector 10 further includes terminal fittings 30. Each terminal fitting 30 is formed as a long straight narrow pin. However, each terminal fitting 30 then is bent into a substantially L-shape. More particularly, each terminal fitting 30 includes a substantially right angle bend 31. A terminal-connecting portion 32 extends forward from the bend 31, and a board-connecting portion 33 extends down from the bend 31. The terminal-connecting portion 32 of the terminal fitting 30 has a substantially rectangular cross section with dimensions that slightly exceed the cross-sectional dimensions of the press-in hole 13. A press-fit portion 34 is formed at the distal or bottom end of the board-connecting portion 33 (see FIG. 7). The press-fit portion 34 is formed by vertically cutting a substantially widthwise middle of the board-connecting portion 33 to define two vertically long resilient pieces 34*a*.

The terminal connecting portion 32 of the terminal fitting 30 is pressed from behind along a pressing direction PD into a corresponding one of the press-in holes 13 in the rear wall 11*a* of the housing 11. Thus, a substantially front half of the terminal connecting portion 32 projects forward into the receptacle 12 from the facing surface 15 of the rear wall 11*a* to face the mating connector 40.

The terminal connecting portion 32 is slightly larger than the press-in hole 13. Thus, the press fitting of the terminal connecting portion 32 along the pressing direction PD and into the press-in hole 13 pushes the resin of the rear wall 11*a* out toward the facing surface 15. This pushed-out portion creates a bulge 13*a* that extends toward the facing surface 15 and in the pressing direction PD at locations adjacent the outer peripheral surface of the terminal connecting portion 32. However, the recess 17 is formed in the facing surface 15 around the entire periphery of the press-in hole 13. The depth of the recesses 17 along the pressing direction PD is set to exceed the expected height of the bulge 13*a*. Thus, the bulge 13*a* is accommodated in the recess 17 and does not project forward from the facing surface 15.

A rear portion of the terminal connecting portion 32, the bend 31 and the board connecting portion 33 are located behind the rear wall 11*a*. The respective board connecting portions 33 are introduced through the positioning holes 21 of the alignment plate 20, and hence are positioned to conform to through holes H formed in a circuit board P. The press-fit portions 34 project below the alignment plate 20 and therefore are ready for connection with the through holes H.

The bottom wall of the receptacle 12 and the alignment plate 20 are placed on the upper surface of the circuit board P, and the press-fit portions 34 of the respective terminal fittings 30 are inserted into the corresponding through holes H while resiliently deforming the resilient pieces 34*a*. The resilient pieces 34*a* of the inserted press-fit portions 34 are brought resiliently into contact with the inner wall surfaces of the through holes H. As a result, the terminal fittings 30 and the circuit board P are connected at a specified contact pressure.

The female connector 40 accommodates female terminal fittings 41, and a flat plate-shaped lever 42 is supported rotatably on the upper side of the female connector 40. The female connector 40 is fittable into the receptacle 12 to achieve connection with the circuit board connector 10 mounted on the circuit board P.

The female connector 40 is fit lightly into the receptacle 12 to engage the cam pin 18 with the entrance of a cam groove 43 of the lever 42. The lever 42 then is rotated. As a result, the two connectors 10, 40 are pulled toward each other by a cam action caused by the engagement of the cam groove 43 and the cam pin 18. The two connectors 10, 40 reach their properly connected state when the lever 42 is rotated to a specified position.

As described above, the long narrow terminal fittings 30 are pressed forward in the pressing direction PD into the press-in holes 13 in the housing 11 so that the leading ends of the terminal fittings 30 project beyond the facing surface 15 of the housing 11. The resin in the rear wall 11*a* at locations near the press-in holes 13 may deform toward the facing surface 15 in response to forces created as the terminal fittings 30 are pressed into the press-in holes 13. These deformations may create bulges 13*a* that project towards the facing surface 15. However, the recesses 17 are formed in the facing surface 15 at locations surrounding the press-in holes 13. As a result, the bulges 13*a* created by the press fitting of the terminal fittings 30 are accommodated in the recess 17 and do not project forward from the facing surface 15 (see FIGS. 9 and 10). Thus, the bulges 13*a* do not impede the ability of the female connector 40 to contact the facing surface 15 of the circuit board connector 10, and proper connection of the connectors 10 and 40 can be achieved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

A circuit board connector is illustrated in the foregoing embodiment. However, the invention also is applicable to other types of connectors assembled by pressing terminal fittings into a housing.

The board connecting portions are of the press-fit type in the foregoing embodiment. However, the invention also is applicable to cases where the board connecting portions are connected with the circuit board by soldering.

The terminal fittings are bent into L-shape in the foregoing embodiment. However, the invention also is applicable to cases where the terminal fittings are substantially straight.

The connectors are connected using the cam action by the lever in the foregoing embodiment. However, the present invention also is applicable to cases where the connectors are connected without using a lever or other movable member displaying a cam action.

Although the recesses are formed into substantially rectangular dents in the foregoing embodiment, they may be curved to have a substantially spherical or elliptic or rounded surface according to the present invention.

What is claimed is:

1. A connector comprising a resin housing with a wall having a rear surface and a facing surface, at least one press-in hole formed through the wall from the rear surface to the facing surface, at least one terminal fitting pressed in a pressing direction into the press-in hole such that a leading end of the terminal fitting with respect to the pressing direction projects out from the facing surface of the wall, wherein at least one concave recess is formed in the facing surface at locations adjacent the press-in hole and at least one convex bulge formed in the concave recess and surrounding the leading end of the terminal fitting due to deformation of the resin of the housing in response to pressing the terminal fitting into the press-in hole, the convex bulge being dimensioned to fit entirely within the concave recess and below the facing surface of the wall.

2. The connector of claim 1, wherein the recess is formed completely around the press-in hole on the facing surface.

3. The connector of claim 1, wherein the leading end of the terminal fitting pressed in the press-in hole is larger than the press-in hole.

4. The connector of claim 1, wherein the wall of the housing has at least one projection on the rear surface, the press-in hole being formed through the projection.

5. The connector of claim 1, wherein the rear surface of the wall has a tapered guide surrounding the press-in hole for guiding the insertion of the terminal fitting into the press-in hole.

6. The connector of claim 1, wherein the terminal fitting has a rear end bent substantially normal to the pressing direction at locations rearward of the wall.

7. The connector of claim 6, further comprising an alignment plate with at least one positioning hole, the rear end of the terminal fitting being inserted in the positioning hole of the alignment plate.

8. The connector of claim 1, further comprising a cam means configured for cooperation with a mating cam means of a mating connector for connecting the connector with the mating connector.

9. The connector of claim 1, wherein the terminal fitting comprises a resilient connecting portion for resilient contact with corresponding contact portions of a contact member.

10. A connector comprising a resin housing with a receptacle having an open front end and a rear wall, the rear wall having a rear surface and a facing surface facing into the receptacle, press-in holes formed through the rear wall, terminal fittings having cross-sections larger than the respective press-in holes, the terminal fittings being pressed in a pressing direction into the press-in holes so that leading ends of the terminal fittings with respect to the pressing direction project into the receptacle, concave recesses formed in the facing surface at locations surrounding the respective press-in holes, convex bulges created in the concave recesses by the press fitting of the terminal fittings into the press-in holes, the convex bulges being disposed entirely in the recesses and not projecting beyond the facing surface into the receptacle.

11. The connector of claim 10, wherein the rear wall of the housing has projections on the rear surface, the press-in holes being formed respectively through the projections.

12. The connector of claim 11, wherein projections on the rear surface of the rear wall have tapered guides surrounding the respective press-in holes for guiding the insertion of the terminal fittings into the press-in holes.

13. The connector of claim 12, wherein each of the terminal fittings has a rear end bent substantially normal to the pressing direction at locations rearward of the rear wall.

14. The connector of claim 13, further comprising an alignment plate with positioning holes, the rear ends of the respective terminal fittings being inserted in the respective positioning holes of the alignment plate.

15. The connector of claim 10, wherein each of said recesses is formed initially to be substantially rectangular with a bottom wall substantially normal to the press-in holes and side walls extending orthogonally from the bottom wall, the convex bulge projecting from the bottom wall and towards the facing surface.

16. The connector of claim 10, portions of each of the terminal fittings from the leading ends thereof to portions rearward of the rear surface of the rear wall are of substantially uniform cross-section.

17. The connector of claim 16, wherein each said terminal fitting has a board-connecting portion remote from the leading end, the board connecting portion being cross-sectionally larger than the substantially uniform cross-section of each said terminal fitting from the leading end to the rear surface of the rear wall.

* * * * *